US005097675A

United States Patent [19]

Elsom et al.

[11] Patent Number: 5,097,675

[45] Date of Patent: Mar. 24, 1992

[54] AIR FLOW CONTROL FOR MULTI-PORT REFRIGERATOR DUCT

[75] Inventors: Kyle B. Elsom, Cedar Rapids; Toni L. Vandarakis, Iowa City; Ramon L. Klemmensen, Cedar Falls, all of Iowa

[73] Assignee: Amana Refrigeration Inc., Amana, Iowa

[21] Appl. No.: 701,277

[22] Filed: May 16, 1991

[51] Int. Cl.[5] ..... F25D 17/04

[52] U.S. Cl. ..... 62/408; 62/447

[58] Field of Search ..... 62/440, 441, 443, 447, 62/265, 407, 408, 187; 98/41.3

[56] References Cited

U.S. PATENT DOCUMENTS

| | | | |
|---|---|---|---|
| 2,234,862 | 3/1941 | Gonczi | 62/408 |
| 2,466,851 | 4/1949 | Honerkamp et al. | 98/41.3 |
| 3,364,694 | 1/1968 | Cohen et al. | 62/408 |
| 3,373,576 | 3/1968 | Dodge, III et al. | 62/408 |
| 4,009,591 | 3/1977 | Hester | 62/180 |
| 4,920,758 | 5/1990 | Janke et al. | 62/187 |

*Primary Examiner*—Albert J. Makay
*Assistant Examiner*—William C. Doerrler
*Attorney, Agent, or Firm*—William R. Clark; Richard M. Sharkansky

[57] ABSTRACT

An air flow control for a multi-port refrigerator duct that conveys cold air from the evaporator chamber to a plurality of storage chambers within the fresh food compartment. The duct has a baffle providing individual branches for each storage chamber such that each is substantially coupled directly to the evaporator chamber so that a change in air flow in one branch does not significantly affect the flow in the opposite branch. A manually operated control is mounted within the fresh food compartment and has a face plate with a vent aligned with a liner input aperture communicating with the duct. A shutter disc is captured between the face plate and the liner, and has a tear drop opening. Rotation of the shutter disc alters the location of the tear drop opening and, thus the size of the passageway through the air flow control.

12 Claims, 5 Drawing Sheets

AIR FLOW CONTROL FOR MULTI-PORT REFRIGERATOR DUCT

BACKGROUND OF THE INVENTION

The field of the invention generally relates to refrigerators, and more particularly relates to air flow control apparatus for providing independent control of a multi-port refrigerator duct.

As is well known, a foam-in-place process is commonly used to manufacture domestic refrigerators. In such process, a plastic liner is positioned in a metal shell or cabinet. Then, foam insulation under pressure is injected into the space between the liner and the shell, and the foam flows along the bottom, sides, and top of the liner thereby filling the voids in the space. Subsequently, the foam solidifies and becomes rigid insulation.

In the case of a side-by-side refrigerator, a freezer liner is generally positioned on one side and a fresh food liner is positioned on the opposite side. The two respective liners are spaced so that the foam flows into the region therebetween forming a vertical partition. Typically, an evaporator chamber is formed within the freezer liner, and a single fan is used to circulate air from the freezer and fresh food compartments over the evaporator and back to the respective compartments. The evaporator is activated and the air proportioned so that the freezer compartment is generally maintained at a approximately 0° F. while the fresh food compartment is approximately 40° F. It is also well known that it is desirable to maintain certain foods at an intermediate temperature such as in the range from 32° F.–35° F. For example, meat is commonly stored in a meat keeper drawer within the fresh food compartment, and beverages or foods requiring quick chill are stored temporarily or permanently in a storage compartment typically located in the fresh food door. One important design consideration involves how to convey cold air from the freezer through the partition of foamed-in-place insulation to the storage chambers in the fresh food liner.

U.S. Pat. No. 4,586,347 discloses a side-by-side refrigerator having an intermediate temperature chamber within the fresh food door. A port or passage is provided directly through the vertical partition between freezer and fresh food compartments, and the respective pressures are maintained so that cold air flows from the freezer compartment laterally through the passage in the partition to the storage chamber. However, with a wide range of freezer and fresh food compartment operating conditions such as the size and quantity of stored food, the pressures in the respective compartments may tend to be variable. Therefore, one problem with such arrangement is that it may be difficult to regulate or control the temperature within the storage chamber. Further, there may be additional cold air conveying apparatus required for a meat keeper storage chamber and, if the apparatus is the same as for the door chamber, it may be difficult to provide independent temperature control. That is, by adjusting the temperature setting of the meat keeper or door storage chamber, the temperature of the other may be affected.

SUMMARY OF THE INVENTION

It is an object of the invention to provide controlled independent air flow to two or more intermediate temperature storage chambers within a fresh food compartment of a refrigerator.

It is also an object to provide an air flow control that is laterally thin and mounts against the side liner to control the flow rate of cold air passing through an inlet aperture in the liner to a storage chamber positioned in the fresh food compartment.

It is a further object to provide a manually adjusted rotary control for adjusting the temperature setting of a storage chamber in the fresh food compartment.

It is a further object to provide a rotary air flow control that readily and easily mounts to a cold air duct within the vertical partition and seals the duct at the inlet aperture for a subsequent foam-in-place process.

In accordance with the invention, a refrigerator comprises a fresh food compartment comprising a fresh food liner having first and second inlet apertures, first and second storage chambers disposed in the fresh food compartment, an evaporator positioned outside the fresh food compartment, and means for conveying cold air from the evaporator to cool the first and second storage chambers wherein the conveying means comprises a duct having an inlet port receiving the cold air and first and second outlet ports respectively positioned to discharge the cold air through the first and second liner inlet apertures to cool the first and second storage chambers. It is preferable that the conveying means comprise means for controlling the flow of cold air to the first storage chamber substantially independently of the flow of the cold air to the second storage chamber. It is further preferable that the controlling means comprise a baffle dividing the duct into two branches wherein one branch extends from the inlet port to the first outlet port while the other branch extends from the inlet port to the second outlet port. The controlling means may further comprise a shutter disposed in the fresh food compartment wherein the shutter is a manually actuated rotary shutter.

The invention may also be practiced by a refrigerator comprising a fresh food compartment comprising a fresh food liner having an inlet aperture, a storage chamber disposed in the fresh food compartment, an evaporator disposed external to the fresh food liner, means comprising a duct for conveying cold air from the evaporator to cool the storage chamber wherein the duct has an inlet port receiving the cold air and an outlet port positioned to discharge cold air through the aperture in the liner to the storage chamber. In accordance with the invention, the refrigerator further comprises means for controlling the flow of the cold air to the storage chamber wherein the controlling means comprises a face plate having a vent region and a shutter disc adjacent to face plate, the shutter disc having an opening and being rotatable with respect to the face plate to alter the relative alignment of the opening to the vent region to adjust the size of a passageway through the opening and the vent region. The vent may comprise a grill. Preferably, the face plate may have a perpendicular pin extending through a corresponding pin hole in the shutter disc wherein the pin is inserted into a bore in the duct. Further, the shutter disc may have an arcuate slot and the fresh food liner may have a hole and a clip may extend from the face plate through the arcuate slot and the hole to the duct to stationarily mount the face plate. The arcuate slot may preferably have an undulated edge and the cylinder extending therethrough may have a vane that contacts the undulated edge to provide discrete graduations of rotation for the shutter disc.

BRIEF DESCRIPTION OF THE DRAWINGS

The foregoing objects and advantages will be more fully understood by reading the Description of the Preferred Embodiment with reference to the drawings wherein.

DESCRIPTION OF THE PREFERRED EMBODIMENTS

Figure 1:
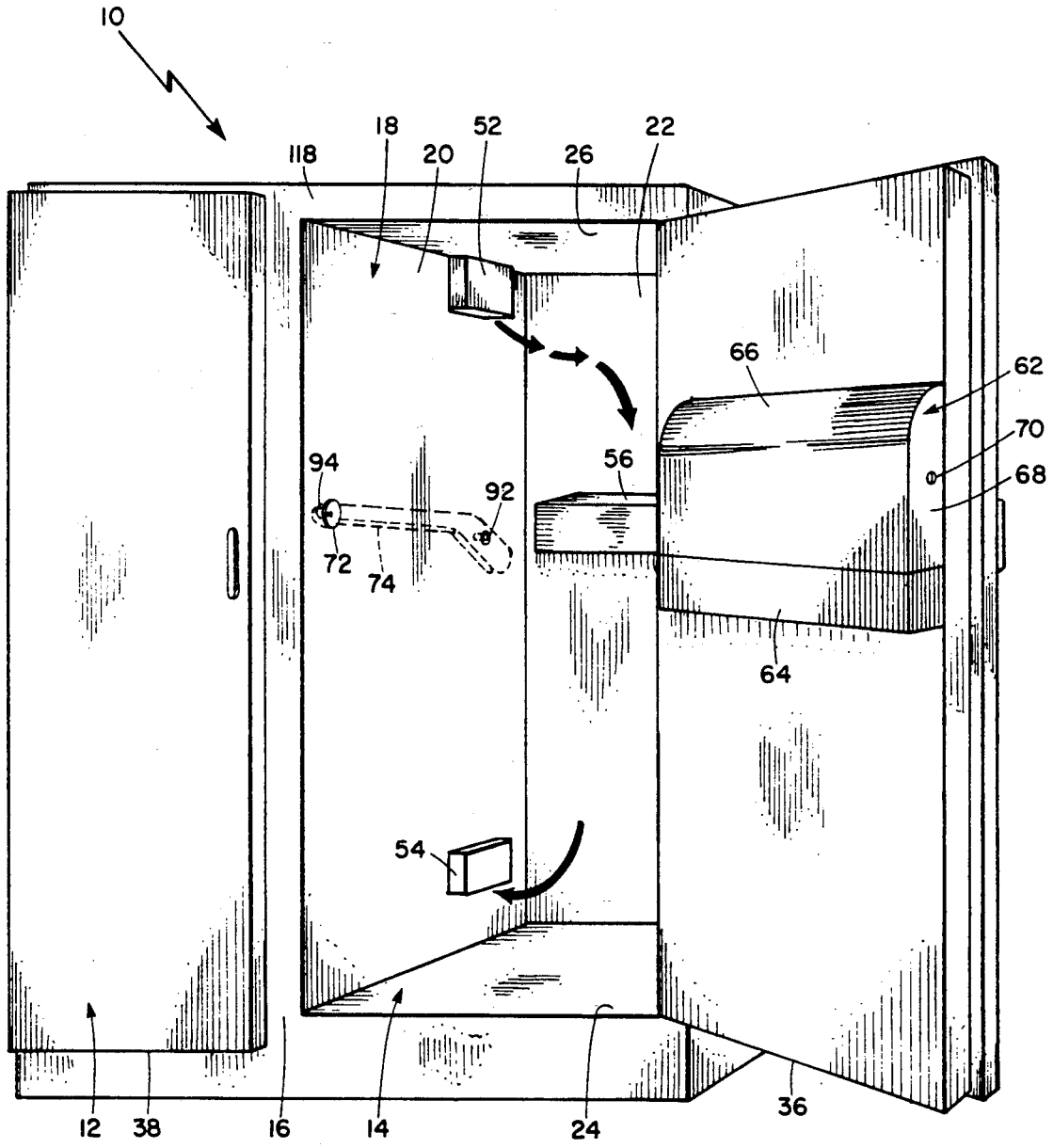
FIG. 1 is a front perspective view of a side-by-side refrigerator.
Figure 2:
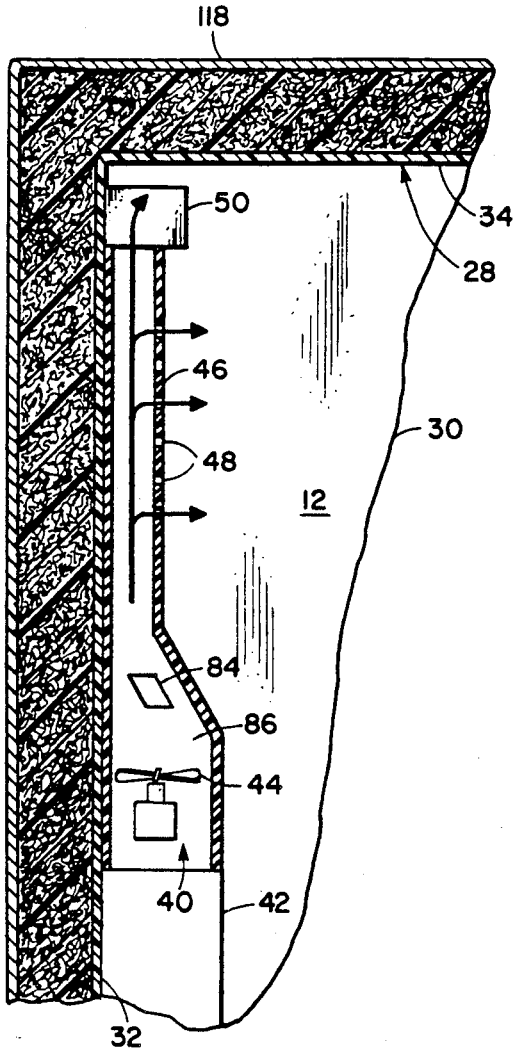
FIG. 2 is a side sectioned view of the evaporator chamber within the freezer liner.

Referring to the drawings wherein like numerals refer to like parts throughout the several views, FIG. 1 shows a pictorial view of refrigerator 10. Here, refrigerator 10 is a so-called side-by-side refrigerator having a freezer compartment 12 on the left and a fresh food compartment 14 on the right with a vertical partition 16 therebetween. The fresh food compartment 14 is formed or bounded by a fresh food liner 18 having side walls 20, a back wall 22, a floor 24, and a ceiling 26. With reference to FIG. 2, freezer compartment 12 is formed or bounded by freezer liner 28 having side walls 30, back wall 32, floor (not shown), and ceiling 34. Door 36 seals the fresh food compartment 14, and door 38 seals freezer compartment 12.

Still referring to FIG. 2, evaporator chamber 40 is disposed in the rear of freezer liner 28 and houses evaporator 42 and fan 44. In conventional manner, evaporator 42 is cooled by a refrigerant loop (not shown) and fan 44 draws sub-freezing air up from evaporator 42 and directs the cold air upwardly into air baffle 46 which extends substantially the full width of freezer compartment 12. A portion of the cold air is directed forwardly into the freezer compartment 12 through discharge vents 48 in air baffle 46, and another portion is directed into the fresh food air supply passage 50 to the control damper 52 in the fresh food compartment 14 as shown in FIG. 1. Control damper 52 has a conventional operator controlled thermostat that regulates the amount of cold air flowing into fresh food compartment 14. Air from fresh food compartment 14 is recirculated back to the underside of evaporator 42 via fresh food compartment air return passage 54. Similarly, air from freezer compartment 12 is recirculated to the underside of evaporator 42. In such manner, a single fan 44 is used to recirculate sub-freezing or cold air from evaporator chamber 40 through both the freezer compartment 12 and fresh food compartment 14. The relative temperatures of the freezer compartment 12 and fresh food compartment 14 are regulated by a freezer compartment thermostat control (not shown) and control damper 52. Typically, the user will set the controls so that freezer compartment 12 is maintained at approximately 0° F. while fresh food compartment 14 is maintained at approximately 40° F.

Still referring to FIG. 1, conventional meat keeper 56 is suitably mounted in fresh food compartment 14 and, as will be described subsequently, a stream of cold air is directed to meat keeper 56 in order to maintain the interior of meat keeper 56 at a temperature below the rest of the fresh food compartment 14. More specifically, meat keeper 56 may include a segregated food storage chamber or drawer 58 (FIG. 3) surrounded by a sleeve 60, and the cold air is directed within the sleeve 60 in conventional manner so as to maintain meat within drawer 58 at a temperature in the range from 32°-35° F.

Another segregated storage chamber 62 is disposed within door 36. As described in detail in U.S. patent application Ser. No. 534,224, filed June 7, 1990, which is hereby incorporated by reference, storage chamber 62 may typically comprise a lower shelf 64 supporting a vertically slidable inner door 66. Inner door 66 has a side panel 68 with an opening 70 that aligns with air flow control 72 that mounts on wall 20 and regulates the temperature of storage chamber 62. As will be described subsequently, a stream of air is directed from air flow control 72 into storage chamber 62 through opening 70. The cold air maintains storage chamber 62 at a temperature lower than the rest of the fresh food compartment 14. For example, storage chamber 62 may typically be maintained at approximately 32° F. so as to quickly chill certain foods or maintain beverages at a colder temperature than the rest of the fresh food compartment 14.

Figure 3:
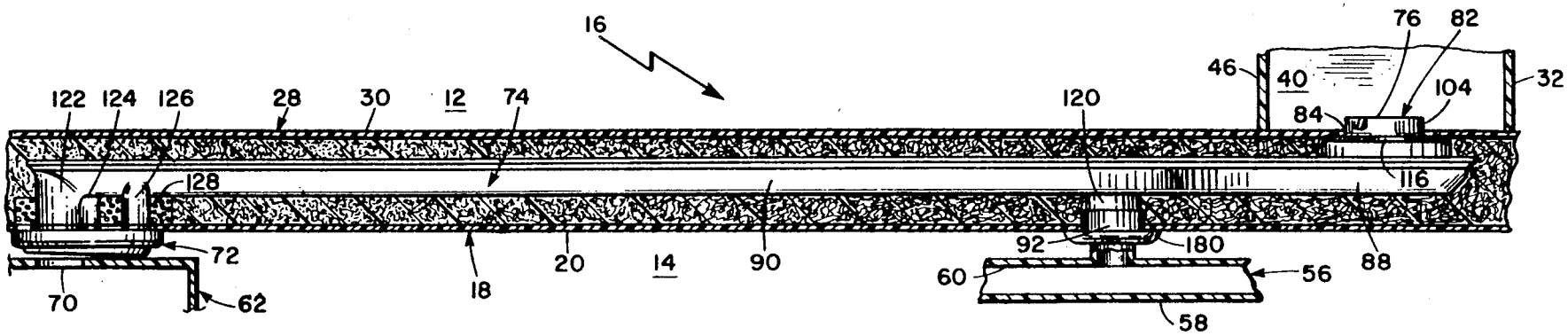
FIG. 3 is a top view of a duct in the vertical partition coupled between the freezer liner and the fresh food liner.
Figure 4:
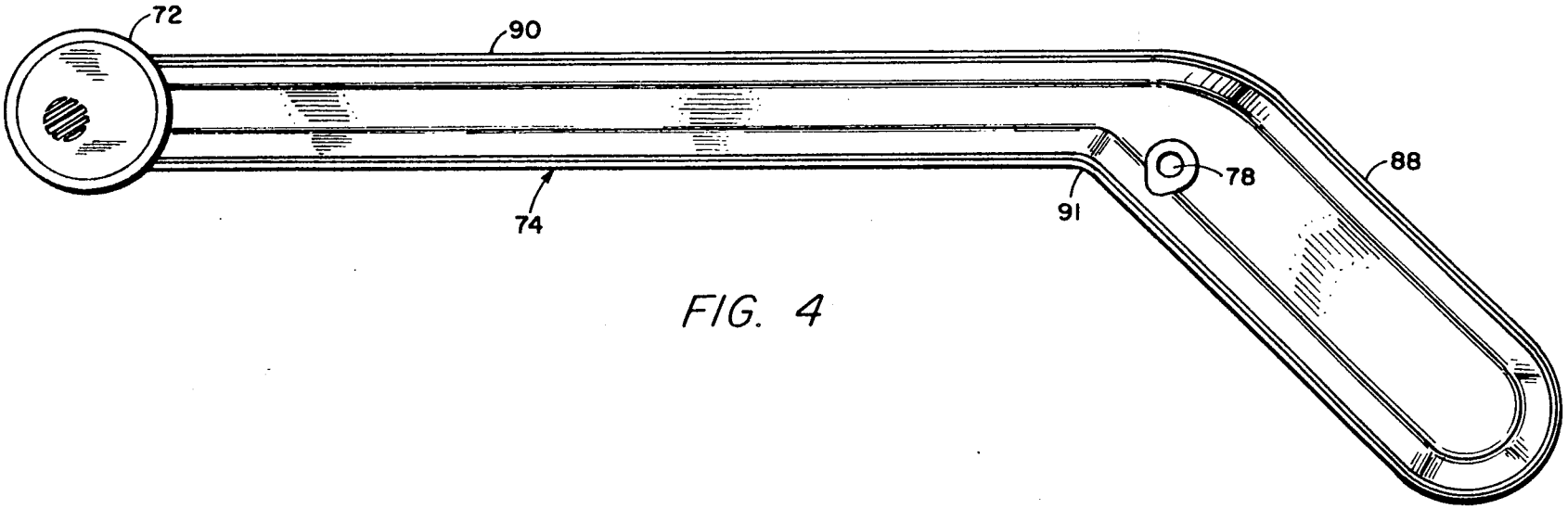
FIG. 4 is a side view of the duct and air flow control from the fresh food compartment side.

Referring to FIG. 3, duct 74 conveys sub-freezing or cold air from evaporator chamber 40 to both the meat keeper 56 and storage chamber 62. More specifically, with reference also to FIGS. 4-8, duct 74 has an inlet port 76 positioned adjacent to a rear end thereof, and outlet ports 78 and 80 for discharging sub-freezing air respectively into meat keeper 56 and storage chamber 62. Inlet port 76 is surrounded by a collar 82 or mating flange that projects laterally and extends through an outlet aperture 84 in the right freezer liner wall 30 to communicate with a plenum region 86 of evaporator chamber 40 above fan 44. With such arrangement, plenum region 86 has slightly positive pressure and therefore cold air from evaporator 42 is forced laterally into duct 74 through inlet port 76. Duct 74 is an assembly of plastic molded parts, and defines a generally elongated conduit that is preferably trapezoid shaped to enable the easy flow of foam around duct 74 during fabrication. Duct 74 has first and second legs 88 and 90 with an bend 91 therebetween generally arranged so that duct 74 covers or is aligned with fresh food liner inlet apertures 92 and 94 which communicate with meat keeper 56 and storage chamber 62, respectively.

Figure 6:
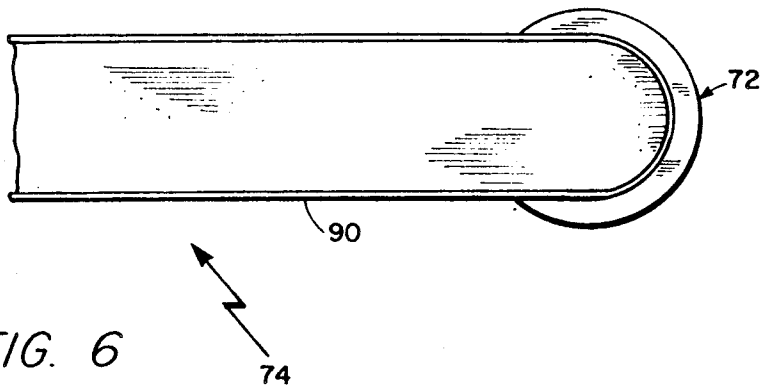
FIG. 6 is a partially broken away side view of the duct from the freezer compartment side.

Referring to FIG. 6, leg 88 has a longitudinal baffle 96 or partition that separates leg 88 into two parallel branches 98*a* and 98*b*. Branch 98*b* includes outlet port 78 and terminates with end wall 100 whereas branch 98*a* continues around bend 91 and down leg 90 to outlet port 80. With such arrangement, the flow of cold air from inlet port 76 to outlet port 78 and outlet port 80 is substantially isolated such that flow to one does not substantially affect flow to the other. Therefore, in a manner to be described subsequently, the temperature of meat keeper 56 and storage chamber 62 can be independently controlled. As shown, the cross section of leg 88 is larger than leg 90. For example, the cross-sectional area of branch 98*a* and 98*b* and leg 90 may be approximately equal so that a sufficient stream of cold air can be provided to both meat keeper 56 and storage chamber 62.

Figure 7:
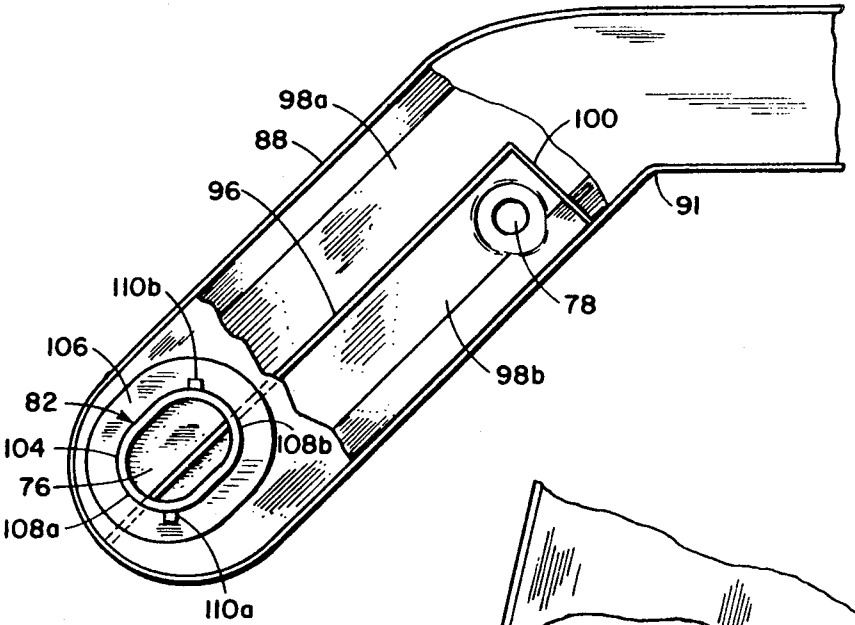
FIG. 7 is a view of the collar or attaching flange in position for insertion through the outlet aperture in the wall of the freezer liner.
Figure 7:
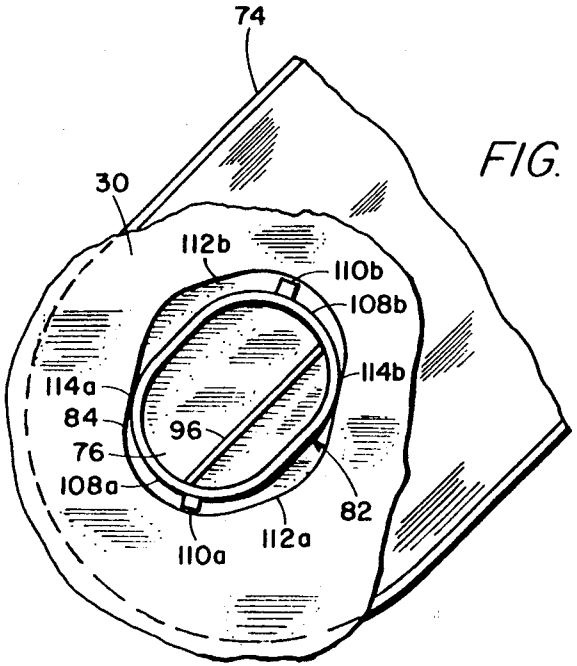
Figure 8:
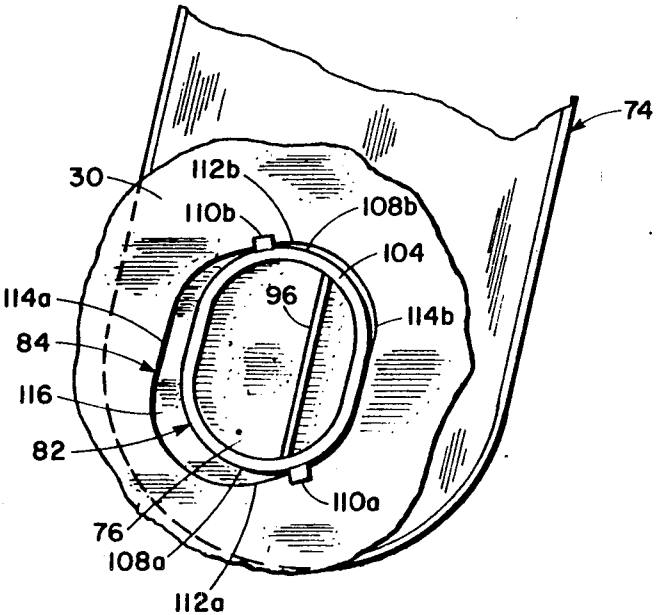
FIG. 8 is a view of the collar and duct rotated to a second rotational orientation wherein the ears interlock with peripheral portions of the outlet aperture.

During fabrication, duct 74 is initially attached to freezer liner 28. More specifically, with reference to FIGS. 2 and 6–8, collar 82 or mating flange has a distal portion 104 of reduced cross section thereby defining a shoulder 106. Distal portion 104 has an oval shape or an elongated form having rounded ends 108*a* and *b* from which project ears 110*a* and *b* or lugs at an angle from the longitudinal direction. Outlet aperture 84 in wall 30 of freezer liner 28 has a shape generally conforming to the shape of distal portion 104, but is also elongated in a generally transverse or orthogonal direction. Thus, outlet aperture 84 generally has a parallelogram shape with respective parallel edges 112*a* and *b* and 114*a* and *b* with rounded corners conforming to distal portion 104 therebetween. The dimensions are such that ears 110*a* and *b* are only insertable through outlet aperture 84 in a predetermined rotation orientation of duct 74 to side wall 30 of liner 28 as shown in FIG. 7. Therefore, in this predetermined orientation, distal portion 104 of latching collar 82 is inserted through outlet aperture 84 until gasket 116 contacts the outer surface of side wall 30 and is sandwiched between side wall 30 and shoulder 106. Then, as shown in FIG. 8, duct 74 and collar 82 are rotated to a second predetermined orientation wherein ears 110*a* and *b* rotate and engage peripheral portions along edges 112*a* and *b* thereby latching collar 82 and duct 74 to side wall 30 of freezer liner 28. In other words, duct 74 is interlocked to freezer liner 30 and a sealed coupling or joint is formed. In order to temporarily hold duct 74 in the latched or mated orientation shown in FIG. 8, the front end of leg 90 is temporarily taped to side wall 30 of freezer liner 28. Next, the freezer liner 28 is lowered in to the left side of the refrigerator cabinet 118 which is an outer metal shell or casing.

Figure 5:
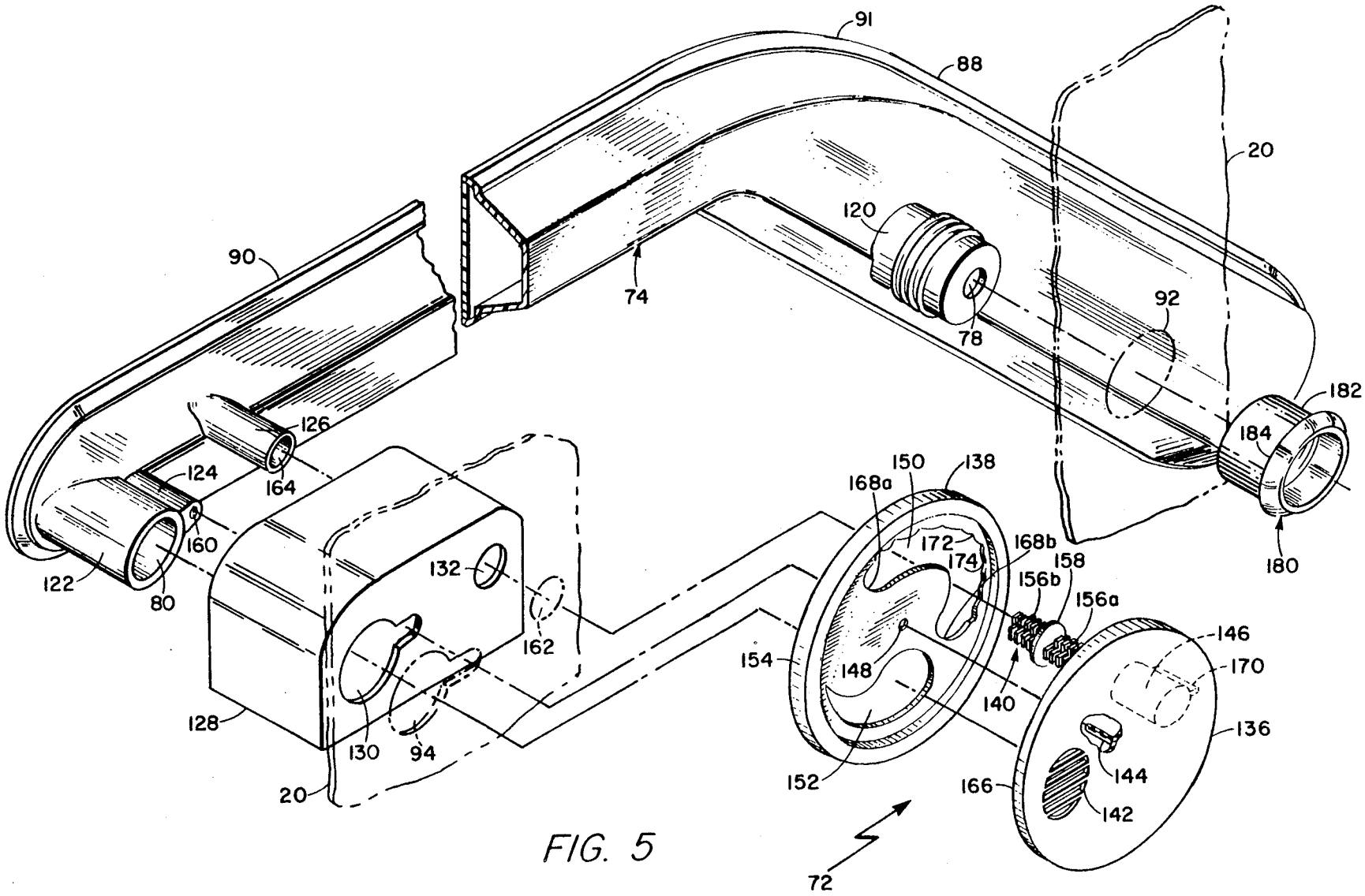
FIG. 5 is a perspective view of the duct with the air flow control exploded.

Referring to FIG. 5, outlet port 78 has a laterally extending cylindrical tunnel 120 or neck and outlet port 80 has a laterally extending tunnel 122 or neck having an axial rib 124. Further, as shown, a hollow cylinder or boss 126 extends adjacently parallel to tunnel 122. An EBS sealing block 128 having through cut-out portions 130 and 132 conforming respectively to tunnel 122 and boss 126 is inserted onto tunnel 122 and boss 126 and held in place by an interference fit.

In the next step of fabrication, the fresh food liner 18 is lowered into cabinet 118 laterally adjacent to freezer liner 28. Due to production tolerances and the fact that duct 74 is to run from the freezer liner 28 to the fresh food liner 18 which may be slightly misaligned from front-to-back and/or top-to-bottom, outlet ports 78 and 80 may not accurately align with respective inlet apertures 92 and 94 of fresh food liner 18. In order to compensate for any such misalignment, the heretofore described temporary holding tape is removed from duct 74, and then the front of duct 74 is adjusted to align outlet ports 78 and 80 with respective inlet apertures 92 and 94. More specifically, referring again to FIG. 8, distal portion 104 of latching collar 82 is free to move within outlet aperture 84 in the second predetermined or latched orientation of duct 74 to side wall 30 without disengaging ears 110*a* and *b* from respective peripheral portions along edges 112*a* and *b*. That is, distal portion 104 can here move forward and backward approximately ⅜" while ears 110*a* and *b* move in sliding engagement with and remain engaged to peripheral portions along edges 112*a* and *b*. Also, duct 74 may be slightly rotated from the orientation shown in FIG. 8 to provide some vertical alignment of outlet port 78 and 80 to respective inlet apertures 92 and 94. During such adjustment of duct 74 to align respective outlet ports 78 and 80 to inlet apertures 92 and 94, gasket 116 keeps latching collar 82 sealed to side wall 30 of freezer liner 28. In summary, outlet aperture 84 is formed so that substantially parallel edges 112*a* and *b* are larger than corresponding dimensions of collar 82 so that the joint or coupling so formed can be adjusted to align the outlet ports 78 and 80 while maintaining a seal at the joint.

Still referring to FIG. 5, air flow control 72 includes stationary circular face plate 136, rotatable shutter disc 138, and fastener clip 140. As shown, face plate 136 has a vent region 142 or grill, a perpendicularly extending central pin 144, and a perpendicularly projecting hollow cylinder 146. Rotatable shutter disc 138 has a central pin hole 148 adapted for receiving pin 144, and an arcuate slot 150 adapted for receiving cylinder 146. Rotatable disc 138 or shutter also has a tear drop opening 152 or air passage hole and a raised rim 154. During assembly, pin 144 is inserted through pin hole 148 with cylinder 146 extending through arcuate slot 150. Clip 140 has sets of resilient prongs 156*a* and *b* or fingers extending radially from both sides of disc 158. During assembly, the set of resilient prongs 156*a* is inserted in bore 147 of hollow cylinder 146. Inlet aperture 94 in side wall 20 of fresh food liner 18 is shaped to receive pin 144 which inserts in bore 160 of rib 124. Also, a separate hole 162 is disposed in alignment with hollow cylinder 126. The set of resilient prongs 156*b* inserts through hole 162 and securely engages into bore 164 of hollow cylinder 126 as pin 144 slides into bore 160. With such arrangement, clip 140, which is a so-called christmas tree clip, securely engages or mounts circular face plate 136 to duct 74, and prevents rotation of face plate about pin 144. In the fixed orientation, vent region 142 aligns with outlet port 80. In the described arrangement, rotatable shutter disc 138 is sandwiched between face plate 136 and liner wall 20. More specifically, face plate 136 has a lip 166 that seats against an annular portion of rotatable disc 138 inside raised rim 154 there capturing or locking rotatable shutter disc 138 against liner wall 20. However, rotatable shutter disc 138 is free to rotate on pin 144 within the arc of arcuate slot 150. That is, stationary clip 140 passes through arcuate slot 150 and rotatable shutter disc 138 can be rotated until the extremities 168*a* and *b* of slot engage clip 40.

Figure 9:
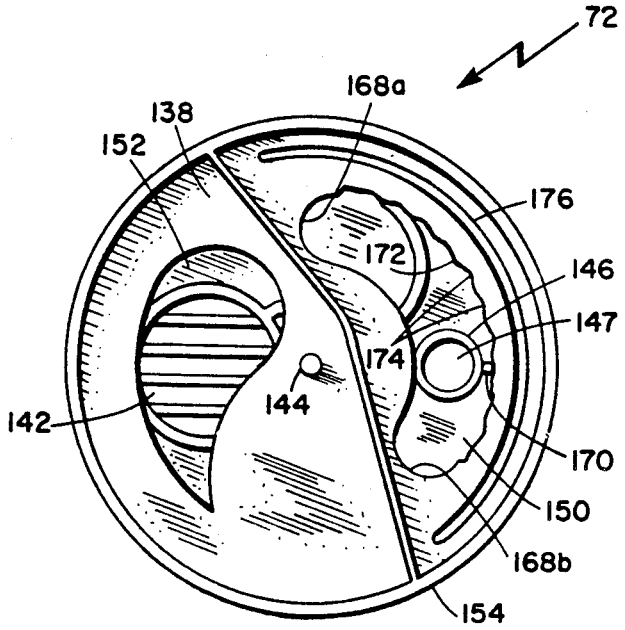
FIG. 9 is a rear view of the air flow control.

Referring to FIG. 9, hollow cylinder 146 has a vane 170 that engages a rippled or undulated edge 172 of arcuate slot 150. That is, slot 150 has a plurality of spaced indents 174. Rotatable shutter disc 138 also has an arcuate slit 176 to provide flex for edge 172. In such arrangement, cylinder 146 and vane 170 have an interference fit within arcuate slot 150 so there is calibrated resistance to rotation of rotatable shutter disc 138. Thus, as the operator grasps rim 154 of rotatable shutter disc 138 and exerts a rotational force to adjust the temperature setting of storage chamber 62, rotatable shutter disc 138 has the feel of clicking through a plurality of discrete positions or settings and, once settled in a position, the rotational friction is such that rotatable shutter disc 138 is secured in that position.

Still referring to FIG. 9 and also to FIG. 5, tear drop opening 152 is configured and oriented so that varying portions of tear drop opening 152 align with the grill of vent region 142 as rotatable shutter disc 138 is manually rotated between the ends of its rotatable arc defined by extremities 168*a* and *b* contacting clip 140. Thus, the size of the passageway through tear drop opening 152 and vent region 142 depends on the rotational orientation of rotatable shutter disc 138. In such manner, the operator manually rotates rotatable shutter disc 138 to set the air flow through air flow control 72. Referring again to FIG. 3, vent region 42 aligns with opening 70 into storage chamber 62. Therefore, the cold air flow from duct 74 into storage chamber 62 and thus the temperature within storage chamber 62 can be regulated by rotating rotatable shutter disc 138 either clockwise or counter-clockwise from maximum to minimum cooling.

Referring again to FIG. 5, convention grommet 180 is next inserted through inlet aperture 92. Grommet 180 has a barrel 182 which snugly fits around tunnel 120 providing a seal, and flange 184 seals to liner 20.

Referring again to FIG. 3, the fabrication process continues by foaming-in-place vertical partition 16 along with the other regions spaced between respective liners 18 and 28 and cabinet 118. As shown best in FIG. 5, duct 74 is of a trapezoid shape to improve the flow of foam vertically across duct 74. Next, the evaporator chamber 140 is formed in the rear of freezer liner 28.

In summary, duct 74 is coupled from freezer liner 28 to fresh food liner 18 to provide a flow of cold air directly from evaporator chamber 40 to meat keeper 56 and storage chamber 62. With such arrangement, the cold air is provided from a relatively constant pressure source. The coupling of latching collar 82 to outlet aperture 84 permits front-to-back and some vertical motion of duct 74 with respect to freezer liner 28 so that outlet ports 78 and 80 can be adjusted to align with respective inlet apertures 92 and 94; such adjustment compensates for tolerance in the alignment between fresh food liner 18 and freezer liner 28. Further, even though only one duct 74 is used to supply cold air to both meat keeper 56 and storage chamber 62, individual temperature control of the two storage chambers 56 and 62 is provided. More specifically, baffle 96 provides isolation between separate branches 98*a* and *b* within duct 74, and each branch 98*a* and *b* substantially communicates with plenum region 86 which has a relative constant pressure when fan 44 is operating. Thus, because each storage chamber 56 and 62 is substantially coupled individually to the plenum region 86, a change in the air flow rate down one branch 98*a* or *b* does not significantly effect the air flow rate to the opposite branch. Also, air flow control 72 provides individual temperature control for storage chamber 62. Meat keeper 56 may also have a conventional individual temperature control (not shown). For example, meat keeper 56 may have a slide control that regulates the flow of air exiting sleeve 60.

This concludes the description of the preferred embodiment. However, a reading of it by one skilled in the art will bring to mind many modifications and alterations which do not depart from the spirit and scope of the invention. Therefore, it is intended that the scope of the invention be limited only by the appended claims.

What is claimed is:

1. A refrigerator comprising:

a fresh food compartment comprising a fresh food liner having first and second inlet apertures;

first and second storage chambers disposed in said fresh food compartment;

an evaporator positioned outside said fresh food compartment;

means for conveying cold air from said evaporator to cool said first and second storage chambers, said conveying means comprising a duct having an inlet port receiving said cold air and first and second outlet ports respectively positioned to discharge said cold air through said first and second liner inlet apertures to cool said first and second storage chambers; and said conveying means comprising means for controlling the flow of cold air to said first storage chamber substantially independently of the flow of said cold air to said second storage chamber, said controlling means comprising a baffle dividing said duct into two branches wherein one of said branches extends from said inlet port to said first outlet port and the opposite one of said branches extends from said inlet port to said second outlet port.

2. The refrigerator recited in claim 1 wherein said controlling means comprises a shutter disposed in said fresh food compartment.

3. The refrigerator recited in claim 2 wherein said shutter is a manually actuated rotary shutter.

4. A method of fabricating a refrigerator, comprising the steps of:

placing a freezer liner having a wall with an air outlet aperture into a cabinet;

providing a duct having an inlet port, an outlet port and a hollow cylinder adjacent said outlet port;

coupling said duct at said inlet port to said air outlet aperture;

placing a fresh food liner having a wall with an inlet aperture and a hole adjacent said inlet aperture into said cabinet so that said wall of said freezer liner and said wall of said fresh food liner face and are spaced from each other to form a partition region in which said duct is positioned with said outlet port being aligned with said inlet aperture;

providing a face plate with a vent region and a perpendicularly extending pin and hollow cylinder;

providing a shutter disc having a pin hole, an opening and an arcuate slot;

inserting said pin and hollow cylinder of said face plate respectively through said pin hole and arcuate slot of said shutter disc; and fastening said hollow cylinders of said face plate an said duct with a fastener comprising a clip having radially extending resilient prongs engaging said hollow cylinders, said fastener extending through said liner hole to secure said face plate to said duct with said shutter disc captured between said face plate and said fresh food liner wherein air flow through said duct can be adjusted by rotating said shutter disc to alter the alignment of said shutter opening with said vent region of said face plate.

5. A refrigerator comprising:

a fresh food compartment comprising a fresh food liner having an inlet aperture;

a storage chamber disposed in said fresh food compartment;

an evaporator disposed external to said fresh food liner;

means comprising a duct for conveying cold air from said evaporator to cool said storage chamber, said duct having an inlet port receiving said cold air and an outlet port positioned to discharge cold air through said liner inlet aperture to said storage chamber;

means for controlling the flow of said cold air to said storage chamber, said controlling means comprising a face plate having a vent region and a shutter disc adjacent said face plate, said shutter disc having an opening, said shutter disc being rotatable with respect to said face plate to alter the relative alignment of said opening to said vent region to adjust the size of a passageway through said opening and said vent region;

said face plate having a perpendicular pin extending through a corresponding pin hole in said shutter disc, said pin being inserted in a bore in said duct;

said shutter disc having an arcuate slot and said fresh food liner has a hole, said refrigerator further comprising a clip extending from said face plate through said arcuate slot and said hole to said duct to stationarily mount said face plate; and said face plate and said duct having facing hollow cylinders and said clip comprising resilient radial prongs engaged in said respective cylinders to mount said face plate.

6. The refrigerator recited in claim 5 wherein said shutter disc is captured by said face plate and free to rotate about said pin between the extremities of said arcuate slot contacting said clip.

7. The refrigerator recited in claim 6 wherein said arcuate slot has an undulated edge and said cylinder of said face plate has a vane contacting said undulated edge to provide discrete graduations of rotation of said shutter disc.

8. The refrigerator recited in claim 5 wherein said shutter disc comprises an axially extending flange seated against said fresh food liner.

9. The refrigerator recited in claim 5 further comprising a second storage chamber disposed in said fresh food compartment, a second inlet aperture in said fresh food liner, and a second outlet port in said duct to discharge cold air through said second inlet aperture to said second storage chamber.

10. The refrigerator recited in claim 9 further comprising a baffle in said duct providing separate branches to said outlet ports of said duct.

11. The refrigerator recited in claim 5 wherein said vent region comprises a grill.

12. A method of fabricating a refrigerator, comprising the steps of:

placing a freezer liner having a wall with an air outlet aperture into a cabinet;

providing a duct having an inlet port, an outlet port and a hollow cylinder adjacent said outlet port;

coupling said duct at said inlet port to said air outlet aperture;

placing a fresh food liner having a wall with an inlet aperture and a hole adjacent said inlet aperture into said cabinet so that said wall of said freezer liner and said wall of said fresh food liner face and are spaced from each other to form a partition region in which said duct is positioned with said outlet port being aligned with said inlet aperture;

providing a face plate with a vent region and a perpendicularly extending pin and hollow cylinder;

providing a shutter disc having a pin hole, an opening and an arcuate slot;

inserting said pin and hollow cylinder of said face plate respectively through said pin hole and arcuate slot of said shutter disc;

engaging said hollow cylinders of said face plate and said duct with a fastener extending through said liner hole to secure said face plate to said duct with said shutter disc captured between said face plate an said fresh food liner wherein air flow through said duct can be adjusted by rotating said shutter disc to alter the alignment of said shutter opening with said vent region of said face plate; and foaming-in-place said partition region with insulation.

* * * * *